US006104977A

United States Patent [19]

Avery, Jr.

[11] Patent Number: 6,104,977

[45] **Date of Patent: *Aug. 15, 2000**

[54] METHOD AND SYSTEM FOR ENGINE CONTROL

[75] Inventor: Richard Michael Avery, Jr., West Bloomfield, Mich.

[73] Assignee: Detroit Diesel Corporation, Detroit, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/866,523

[22] Filed: Jun. 4, 1997

[51] Int. Cl.[7] ..... G06G 7/70; F02D 13/04

[52] U.S. Cl. ..... 701/101; 701/111; 701/29; 123/322; 123/436; 340/439

[58] Field of Search ..... 701/101, 102, 701/111, 29; 123/436, 299, 350, 488, 322, 41.12, 352, 357, 182.1, 179.2, 179.4; 60/273, 309; 340/459, 439, 441; 180/271, 54.1

[56] References Cited

U.S. PATENT DOCUMENTS

| | | | |
|---|---|---|---|
| 3,220,392 | 11/1965 | Cummins | 123/97 |
| 4,135,329 | 1/1979 | Trobert | 340/459 |
| 4,537,169 | 8/1985 | Tsuge et al. | 123/325 |
| 4,543,927 | 10/1985 | Luhn et al. | 123/182.1 |
| 4,895,121 | 1/1990 | McCoy et al. | 123/406.13 |
| 4,982,707 | 1/1991 | Maeda et al. | 123/192.2 |
| 5,109,815 | 5/1992 | Maeda et al | 123/192.2 |
| 5,117,790 | 6/1992 | Clarke et al. | 123/321 |
| 5,201,296 | 4/1993 | Wunning et al. | 123/479 |
| 5,205,152 | 4/1993 | Clarke et al. | 73/9 |
| 5,317,998 | 6/1994 | Hanson et al. | 123/179.4 |
| 5,333,576 | 8/1994 | Verkleeren | 123/84.53 |
| 5,350,035 | 9/1994 | Bodier et al. | 180/271 |
| 5,385,019 | 1/1995 | Kulig et al. | 60/599 |
| 5,410,604 | 4/1995 | Saito et al. | 381/71.4 |
| 5,410,882 | 5/1995 | Davies et al. | 60/602 |
| 5,445,128 | 8/1995 | Letang et al. | 123/436 |
| 5,477,827 | 12/1995 | Weisman, II et al. | 123/436 |
| 5,483,927 | 1/1996 | Letang et al. | 123/41.12 |
| 5,544,080 | 8/1996 | Kobayashi et al. | 364/528.15 |
| 5,615,654 | 4/1997 | Weisman, II et al. | 123/350 |
| 5,647,317 | 7/1997 | Weisman, II et al. | 123/299 |
| 5,732,676 | 3/1998 | Weisman et al. | 123/436 |
| 5,847,644 | 12/1998 | Weisman, II et al. | 701/29 |

*Primary Examiner*—Jacques H. Louis-Jacques
*Attorney, Agent, or Firm*—Brooks & Kushman P.C.

[57] ABSTRACT

A system and method for reducing cab vibration during engine shutdown in a vehicle, including an internal combustion engine, an engine brake, and an electronic control unit for controlling the engine and the engine brake, includes logic for determining when a shutdown condition is occurring, and logic for generating a control signal to activate the engine brake during the engine shutdown. In one embodiment, the step of activating the engine brake is performed only after the engine speed has fallen below a pre-determined level. The system and method also preferably include automatically deactivating the engine brake at a pre-selected time, such as when engine RPM falls below a second threshold, to ensure that the engine brake is not activated upon restarting the engine.

12 Claims, 3 Drawing Sheets

METHOD AND SYSTEM FOR ENGINE CONTROL

TECHNICAL FIELD

The present invention relates to a method and system for reducing cab vibration during engine shutdown.

BACKGROUND ART

In the control of compression-ignition internal combustion, or diesel engines, the conventional practice utilizes electronic control units having volatile and nonvolatile memory, input and output driver circuitry, and a processor capable of executing a stored instruction set, to control the various functions of the engine and its associated systems. A particular electronic control unit communicates with a plethora of sensors, actuators, and, sometimes, other electronic control units necessary to control various functions which may include fuel delivery, cooling fan control, engine speed governing and overspeed protection, engine braking, torque control, vehicle speed control, or myriad others. One such method and apparatus for comprehensive integrated engine control is disclosed in U.S. Pat. No. 5,445,128, issued Aug. 29, 1995 to Letang et al for "Method For Engine Control" and assigned to Detroit Diesel Corporation, assignee of the present invention.

One type of engine method and system for obtaining a braking effect on an internal combustion engine involves converting the engine into an air compressor; i.e., by opening a valve to the atmosphere near the end of the compression stroke and closing it shortly afterwards. The momentum of the moving vehicle can be retarded utilizing this system, which is commonly referred to as a "Jake Brake". One such conventional engine braking system is available from Jacobs Manufacturing Company, of Wilmington, Del.

It is also known to utilize an electronic engine control to automatically stop and start an engine in response to selected conditions which are monitored by the engine control system, such as air temperature. PCT Publication No. WO 95/31638, published Nov. 23, 1995 discloses an engine control including such automatic engine shutdown and startup capabilities.

One problem encountered in the implementation of automatic engine shutdown features is an annoying vibration of the cab.

It is therefore desirable to provide a method and system for reducing cab vibration during engine shutdown which may be automatically implemented by electronic engine control units.

SUMMARY OF THE INVENTION

It is therefore one object of the present invention to provide a control system and method which may be implemented as part of a comprehensive integrated electronic engine control unit to reduce cab vibration during engine shutdown.

Carrying out the above object and other objects and features of the present invention, a method and system is provided for reducing cab vibration during engine shutdown in a vehicle, including an internal combustion engine and an electronic control unit for controlling the engine by activating the engine brake. The system includes an electronic control unit in communication with an engine RPM sensor and an engine shutdown condition indicator, input from sensors and/or the engine control, and the logic which is executed to activate the engine brake when the engine is being shutdown. The system preferably monitors engine RPM and activates the engine brake when the engine is in automatic shutdown condition and the engine RPM has fallen below a predetermined engine brake activation threshold. The system also preferably deactivates the engine brake deactivation threshold to ensure that the engine brake is not activated when the engine is subsequently (either automatically or manually) restarted.

The system preferably automatically activates the engine brake only after determining that fuel supply to the engine has been cut-off, thereby ensuring a smooth and efficient shutdown.

The above objects and other objects, features, and advantages of the present invention, will be readily appreciated by one of ordinary skill in the art from the following detailed description of the best mode for carrying out the invention when taken in connection with the accompanying drawings.

BEST MODE FOR CARRYING OUT THE INVENTION

Figure 1:
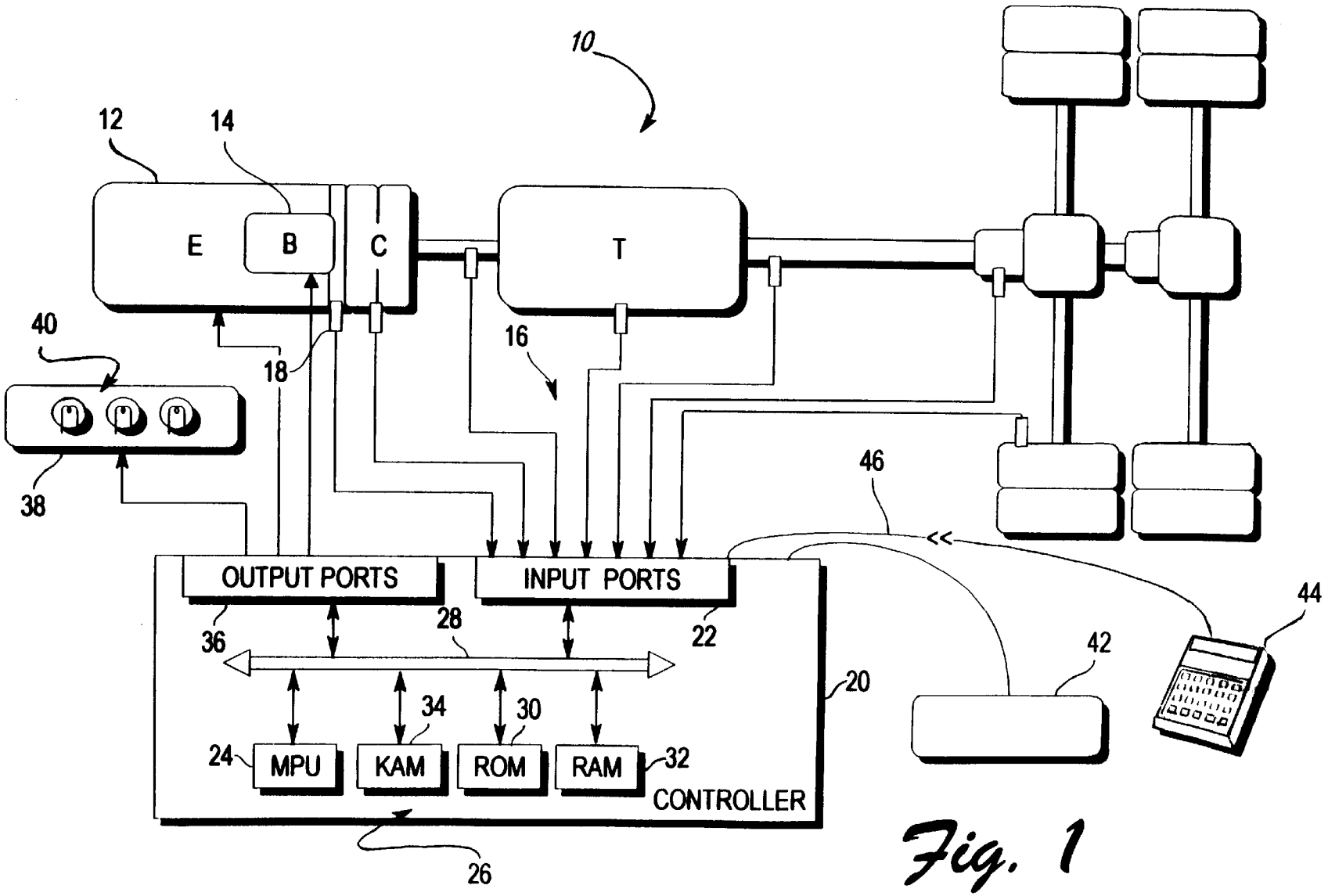
FIG. 1 is a block diagram of the engine shutdown method of the present invention implemented as part of an integrated comprehensive engine control system.

Referring now to FIG. 1, a block diagram of the system and method of the present invention is shown. The system is particularly suited for use in a vehicle 10 which includes an engine 12 which employs an engine braking system 14. A plurality of sensors 16, typically including an engine speed sensors 18 are in electrical communication with the Controller 20 via input ports 22.

The Controller preferably includes a microprocessor 24 in communication with various computer-readable storage media 26 via data and control bus 28. Computer-readable storage media 26 may include any of the number of known devices which function as read-only memory (ROM) 30, random access memory (RAM) 32, keep-alive memory (KAM) 34, and the like. The computer-readable storage media may be implemented by any of a number of known physical devices capable of storing data representing instructions executable via a computer such as Controller 20. Known devices may include but are not limited to PROMs, EPROMs, EEPROMs, flash memory, and the like, in addition to magnetic, optical and combination media capable of temporary or permanent data storage.

Computer-readable storage media 26 include various program instructions, software, and control logic to affect control of various systems and sub-systems of the vehicle 10, such as the engine 12, transmission, and the like. The Controller 20 receives signals from sensors 16 via input ports 22 and generates output signals which may be provided to various actuators and/or components via output ports 36. Signals may also be provided to a display device 38 which includes various indicators such as lights 40 to communicate information relative to system operation to the operator of the vehicle. Display 38 may also include an alpha-numeric portion or other suitable operator interface to provide status information to a vehicle operator or a technician. As such, display 38 represents one or more displays or indicators which may be located throughout the vehicle interior and exterior, but is preferably located in the cab or interior of the vehicle.

A manually operable control switch 42 which may be employed by the vehicle operator to select the desired level of operation of the engine brake. In one engine braking system employed, available from Jacobs Manufacturing Company, of Wilmington, Del., two toggle switches are provided to allow for selection of one of four levels of engine braking corresponding to off, low, medium, and high engine braking. As with other conventional braking systems, engine braking is achieved by increasing the exhaust stroke pressure of at least one of the cylinders. Increased engine braking can be obtained by increasing the number of cylinders, progressively more engine power is dissipated. For example, in a six-cylinder diesel engine, low engine braking is provided by increasing the exhaust stroke pressure of two cylinders whereas medium engine braking increases the exhaust stroke pressure of four cylinders. High engine braking increases the exhaust stroke pressure of all six cylinders. Thus, the operator has the ability to select the degree of engine braking to be employed by the system to achieve a smooth engine shutdown. Alternatively, the operator can override the operation of the present invention by switching the engine brake off, in which case automatic engine shutdown would not employ the engine brake.

A data, diagnostics, and programming interface 44 may also be selectively connected to the Controller 20 via a plug 46 to exchange various information therebetween. Interface 44 may be used to change values within the computer-readable storage media 26, such as configuration settings, calibration variables, control logic and the like.

As previously mentioned, the sensors 16 preferably include an engine speed sensor 18. Engine speed may be detected using any of a number of known sensors which provide signals indicative of rotational speed for the flywheel, or various internal engine components such as the crankshaft, camshaft or the like. In a preferred embodiment, engine speed is determined using a timing reference signal generated by a multi-tooth wheel coupled to the camshaft. As will be appreciated by one of ordinary skill in the art, most vehicle applications will neither require nor utilize all of the sensors illustrated in FIG. 1. As such, it will be appreciated that the objects, features and advantages of the present invention are independent of the particular manner in which the operating parameters are sensed.

In operation, Controller 20 receives signals from sensors and executes control logic embedded in hardware and/or software to monitor the operation of the engine to detect when an engine shutdown has been initiated and, if so, activate the engine brake. As desired, to assist in a smooth shutdown. In a preferred embodiment, Controller 20 is the DDEC III controller available from Detroit Diesel Corporation in Detroit, Mich. Various other features of this controller are described in detail in U.S. Pat. Nos. 5,477,827 and 5,445,128, the disclosures of which are hereby incorporated by reference in their entirety.

The control includes the capability of automatically stopping and starting the engine, such as the type disclosed and described in PCT Publication No. WO 95/31638, which is also hereby incorporated by reference in its entirety.

Figure 2:
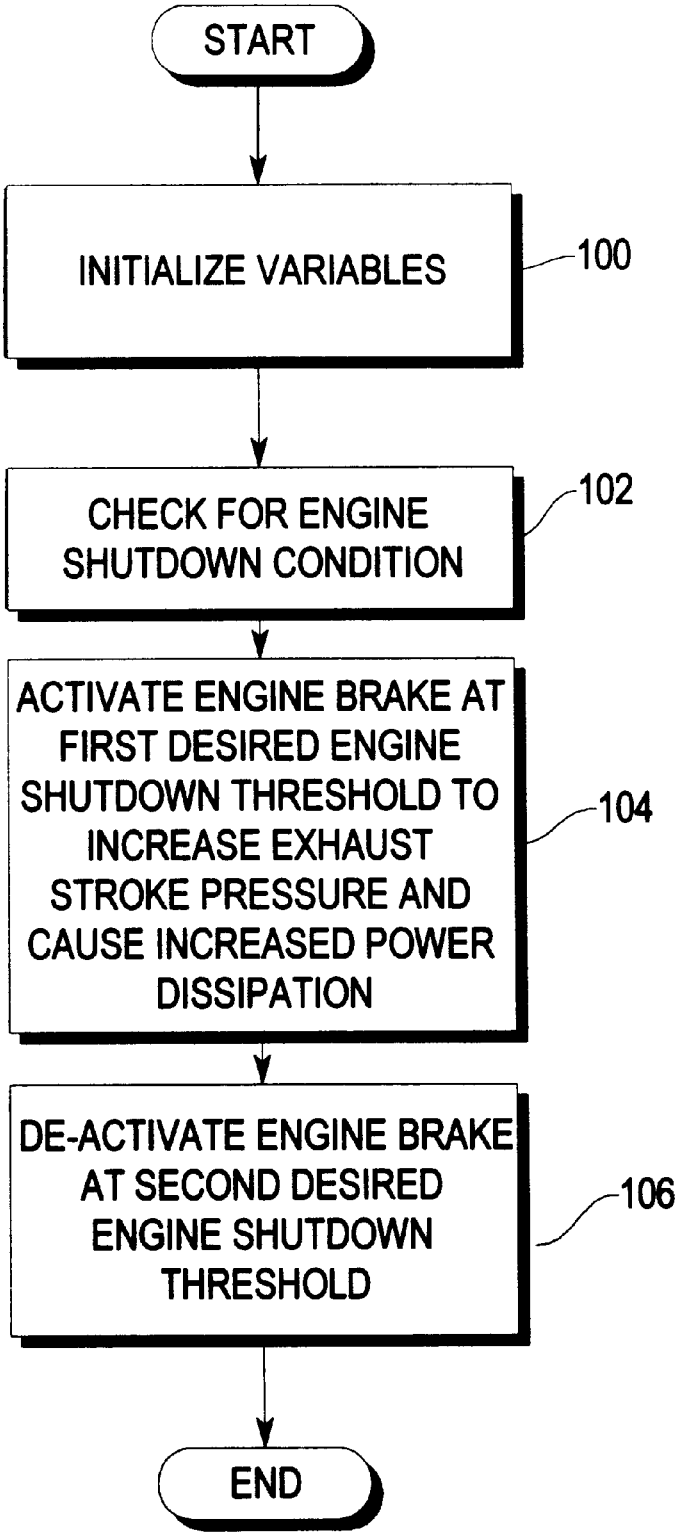
FIG. 2 is a block diagram of the system of the present invention.
Figure 3:
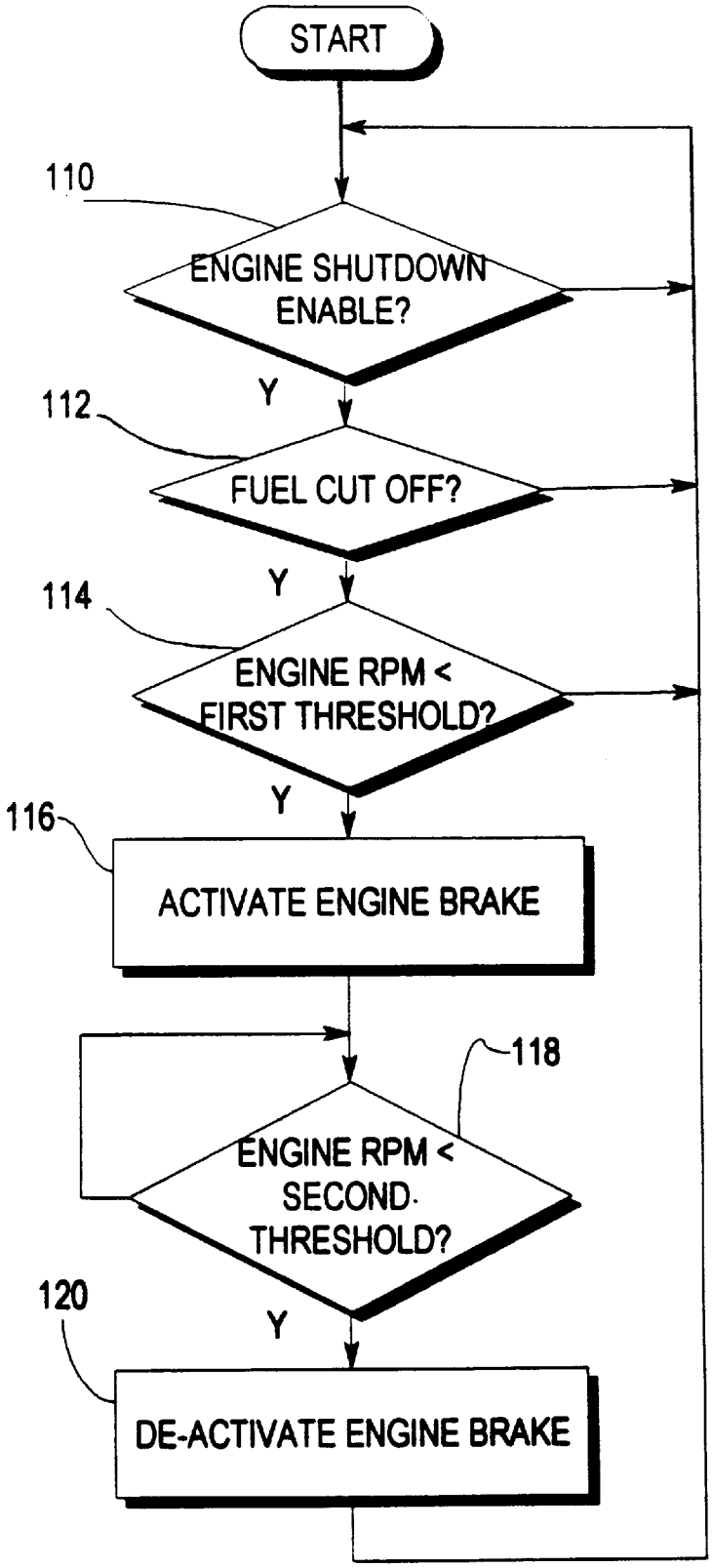
FIG. 3 is a flow diagram of one embodiment of the method and system of the present invention.

Referring now to FIGS. 2 and 3, a diagram and flow chart, respectively, illustrating representative control logic of the system and method of to the present invention are shown. Again, it will be appreciated that the control logic may be implemented or effected in hardware, software, or a combination of hardware and software. The various functions are preferably effected by a programmed microprocessor, such as the DDEC III controller, but may include one or more functions implemented by dedicated electric, electronic, and integrated circuits. As will also be appreciated, the control logic may be implemented using any of a number of known programming and processing techniques or strategies and is not limited to the order or sequence illustrated here for convenience only. For example, interrupt or event-driven processing is typically employed in real-time control applications, such as control of a vehicle engine or transmission. Likewise, parallel processing or multi-tasking systems and methods may be used to accomplish the objects, features, and advantages of the present invention. The present invention is independent of the particular programming language, operating system, or processor used to implement the illustrated control logic.

Referring to FIG. 2, variables are typically initialized, as indicated at 100, upon configuration of the controller. The variables which may be used by the present invention include a first threshold at which the engine brake will be activated on engine shutdown, and a second threshold at which the engine brake will be deactivated prior to complete shutoff of the engine. In one embodiment these thresholds are in engine speed (RPM), and most preferably the first threshold is about 550 RPM and the second threshold is about 50 RPM. Again, there will be appreciated that other parameters may be utilized to implement engine brake activation and deactivation, such as timing thresholds. For example, the first threshold may be a selected amount of time after engine shutdown is initiated (or after fuel cutoff during the engine shutdown process), and the second threshold may be a specific amount of elapsed time from activation of the engine brake. Other variables may be utilized so long as they allow the control to effectively activate the engine brake during shutdown to achieve a smooth shutdown and, preferably, so long as they also allow for timely deactivation of the engine brake so that the engine brake is not active upon restarting the engine.

The system, at 102, then periodically checks for the existence of engine shutdown condition. This may entail checking the control system variable, a system shutdown flag, or monitoring sensor input or other control system variables to determine if fuel supply has been cutoff to the engine. If the control system is automatically shutting down the engine, the system then generates the required control signal, at 104, to activate the engine brake, preferably at a first engine speed threshold of about 550 RPM.

The system also preferably periodically monitors engine speed and, at 106, generates a control signal to deactivate the engine brake at a second threshold, preferably at about 50 RPM, to achieve a smooth engine brake-assisted shutdown of the engine, while leaving the system in condition for smooth start-up with the engine brake deactivated.

It will be appreciated that though it is contemplated that the system of the present invention will be implemented to operate the engine brake upon detection of an automatic system shutdown by the electronic engine controller. The system could additionally or alternatively be configured to activate the engine brake any time the engine is shut down, such as when the operator manually turns off the engine.

Referring to FIG. 3, the system preferably employs logic to check, at 110, to determine whether engine shutoff has been enabled. For example, in the engine control system of the preferred embodiment the controller will automatically shut off the engine under certain pre-select conditions, such as the cab reaching a selected temperature, or a temperature controlled trailer attaining a selected temperature threshold. A shutoff enable indicator, in the form of a software flag or variable would be set under these conditions. This indicator is checked. It is this indicator or other sensed condition associated with engine shutoff that is checked at 110. If engine shutoff is enabled, the system then preferably checks, at 112, to determine whether the engine control has cutoff fuel supply to the engine. If so, the system then detects the current engine speed (RPM), at 114. If the engine speed has fallen below a pre-selected threshold, preferably about 550 RPM, the engine brake is activated, at 116. This is accomplished by sending a suitable control signal to the engine control system as is well-known in the art. Thereafter the system then continues to monitor the engine speed, at 118, and, when the engine speed falls below a pre-selected engine brake deactivation threshold, preferably about 50 RPM, the system deactivates the engine brake, at 120, again by transmitting a suitable control signal.

It would be appreciated that, while the preferred embodiment disclosed in FIG. 3 utilizes selected variables and/or sensed parameters, including an engine shutoff enable indicator, a fuel cut-off indicator, and engine RPM information, the method and system of the present invention may utilize only some of these parameters, or other parameters, to implement engine braking during engine shutdown as taught by the present invention. For example, an alternative embodiment may activate the engine brake on a timed basis following the occurrence of a monitored event, such as automatic engine shutdown, or fuel cutoff. The system may, likewise, deactivate the engine brake after a selected period of time, rather than based upon monitored engine speed.

Various other methods of implementation will be appreciated by those skilled in the art to employ the engine brake to assist in smooth engine shutdown according to the present invention.

Thus, while the best mode contemplated for carrying out the invention has been described in detail, those familiar with the art to which this invention relates will recognize various alternative designs and embodiments for practicing the invention as defined by the following claims.

What is claimed is:

1. A method for reducing cab vibration during engine shutdown in a vehicle including an internal combustion engine and an electronic control unit for controlling the engine, the engine having an engine brake operative to increase exhaust stroke pressure in at least one engine cylinder, the method comprising detecting an automatic shutdown condition, and upon detection of the automatic shutdown condition, increasing the exhaust stroke pressure in the at least one cylinder by activating the engine brake to cause engine power dissipation at the at least one cylinder to increase, resulting in a smooth engine shut down.

2. The method of claim 1 further comprising determining the current engine speed and wherein increasing the exhaust stroke pressure is performed after the engine speed has fallen below a preselected value.

3. The method of claim 2 wherein the preselected value is about 550 r.p.m.

4. The method of claim 1 further comprising determining whether the fuel supply to the engine has been cut off, and wherein increasing the exhaust stroke pressure is performed after the fuel supply to the engine has been cut off.

5. The method of claim 1 further comprising determining the current engine speed and wherein the engine brake is de-activated after the engine speed has fallen below a preselected value.

6. The method of claim 5 wherein the preselected value is about 50 r.p.m.

7. A system for reducing cab vibration during engine shutdown in a vehicle including an internal combustion engine, an engine brake operative to increase exhaust stroke pressure in at least one cylinder, and an electronic control unit for controlling the engine and the engine brake, the system comprising control logic for determining when an engine shutdown condition has occurred and, upon such occurrence, generating a control signal which increases the exhaust stroke pressure in the at least one cylinder by activating the engine brake to cause engine power dissipation at the at least one cylinder to increase, resulting in a smooth engine shutdown.

8. The system of claim 7 wherein the system further includes an engine speed sensor for generating a signal indicative of engine rotational speed, and wherein the control logic is in communication with the engine speed sensor wherein the logic generates the control signal to activate the engine brake when the engine has reached a first pre-selected speed during shutdown.

9. The system of claim 8 further including control logic for generating a signal deactivating the engine brake after the engine has fallen below a second pre-selected speed.

10. The system of claim 9 wherein the second pre-selected speed is about 50 RPM.

11. The system of claim 8 wherein the first pre-selected speed is about 550 RPM.

12. The system of claim 7 wherein the control logic includes an input from the engine control indicating whether fuel to the engine has been cut-off, and wherein the control logic generates a control signal to activate the engine brake after the fuel supply to the engine has been cut-off.

* * * * *